US006527576B1

(12) United States Patent
Omote

(10) Patent No.: US 6,527,576 B1
(45) Date of Patent: Mar. 4, 2003

(54) SOCKET FOR A PRINTED BOARD

(75) Inventor: Shoichi Omote, Tokyo (JP)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/624,424

(22) Filed: Jul. 24, 2000

(30) Foreign Application Priority Data

Jul. 26, 1999 (JP) ..... 11-211322

(51) Int. Cl.[7] ..... H01R 13/62
(52) U.S. Cl. ..... 439/326; 439/350
(58) Field of Search ..... 439/607–610, 439/76.1, 630, 629, 108, 79, 74, 636–637, 326

(56) References Cited

U.S. PATENT DOCUMENTS 5,154,629 A * 10/1992 Carver ..... 439/352
5,197,900 A * 3/1993 Ellis et al. ..... 439/352
5,267,872 A * 12/1993 Gou et al. ..... 439/326
5,305,074 A * 4/1994 Andre et al. ..... 439/417
5,470,237 A * 11/1995 Byczek et al. ..... 439/76.1
5,470,259 A * 11/1995 Kaufman et al. ..... 439/607
5,695,354 A * 12/1997 Noda ..... 439/326
5,775,931 A * 7/1998 Jones ..... 439/358
5,779,494 A * 7/1998 Ito et al. ..... 439/326
5,791,925 A * 8/1998 Yu ..... 439/326
5,803,761 A * 9/1998 Mochizuki ..... 439/326
5,882,223 A * 3/1999 Igarashi ..... 439/495
5,984,708 A * 11/1999 Yu ..... 439/326

FOREIGN PATENT DOCUMENTS

EP 0 542 433 A2 5/1993
EP 0 546 804 A2 6/1993
EP 0 797 276 A2 9/1997

* cited by examiner

*Primary Examiner*—Lynn D. Feild
*Assistant Examiner*—J. F. Duverne
(74) *Attorney, Agent, or Firm*—Harrington & Smith, LLP

(57) ABSTRACT

Providing a socket for a printed board having superior durability, doing no damage to the printed board due to contact therewith, and having a latch arm not requiring labor or time to assemble. The socket (1) for the printed board provides a housing having an insertion opening for the insertion of the printed board, a plurality of spring contacts that project from inside the insertion opening and form contact point rows along the lengthwise direction of the insertion opening, a pair of latch arms that are elastically deformable towards the outside by respectively extending from the housing at both end sides of the lengthwise direction of the insertion opening, and a pair of engagement parts (23) formed on the latch arms (21), and engaging the printed board on the latch arms by resisting the urging force of the spring contacts when the printed board is inserted into the insertion opening and rotated until parallel with the latch arms (21). In addition, the latch arms (21) are reinforced by metallic reinforcing members (31) that support the latch arms (21) form the outside.

19 Claims, 3 Drawing Sheets

SOCKET FOR A PRINTED BOARD

TECHNICAL FIELD OF THE INVENTION

The present invention relates to a socket for a printed board into which the end of a printed board is inserted and having a row of connection points that are directly in contact with contact points formed on the end of the printed board.

BACKGROUND ART

In recent years, along with the need for high density packaging, various sockets for low insertion force type printed boards (direct-type connector) have been developed. This type of connector has a spring contact inside a housing made of resin, and one part of this spring contact is exposed from a groove shaped insertion hole formed in the housing. Thereby, a row of contact points is formed in this insertion opening.

These contact points project into the insertion opening from a pair of opposing walls that surround the insertion opening, and at the same time, the printed board inserted into the insertion opening is disposed so as to be inclined towards one of the opposing walls. That is, the contact point row positioned on the surface of one of the opposing walls projects from the opposing wall towards the interior of the insertion opening, and the contact point row positioned on the surface of the other opposing wall projects from the opposing wall adjacent to the end of the opening of the insertion opening.

In addition, from this housing, at the side of both ends in the lengthwise direction of the insertion opening, a pair of latch arms projects along the direction of the opening of the insertion opening. These latch arms are made of elastically deformable resin or metal at the outside (the side of mutual separation), and on the distal ends, engagement parts projecting towards the inside are provided facing each other.

When mounting the printed board, the distal end of the printed board is inserted into the insertion opening, and the inclining printed board is rotated until it becomes parallel to the latch arm. Thereby, the distal end of the printed board contacts the spring contact, the printed board is urged in the opposite direction of its rotation direction. At the same time, the contact points formed on the distal end of the printed board securely connect with the contact point row formed on the spring contact.

In addition, accompanying the rotating of the printed board, the latch arm elastically deformed towards the outside so that the printed board passes over the engagement part. When the latch arm has passed over the engagement part, it is restored to its original position, and as a result, the movement in the direction opposite to the direction of rotation of the printed board is prevented. The printed board is supported parallel to the latch arm by resisting the urging force of the spring contact, and in this state, is supported by the housing. When the mounted printed board is removed, the engagement between the printed board and the engagement unit is released when the latch arm is elastically deformed towards the outside, and the printed board is restored to its insertion position.

However, among sockets having a latch arm made of resin, the latch arm suffers easily from embrittlement due to the elastic deformation during mounting and release of the printed board, and thus there is a problem of low durability. In contrast, those having latch arms made of metal sometimes damage the printed board due to contact with the latch arm. In addition, because the metallic latch arm must be securely attached to the resin housing, there is the problem that the attachment of the housing and the latch arm requires labor and time.

In consideration of the above-described problems, it is an object of the present invention to provide a socket for a printed board that has superior durability, does not damage the printed board due to contact therewith, and in addition, does not require labor and time for assembly.

SUMMARY OF THE INVENTION

The socket for a printed board of the present invention provides a housing having a groove-shaped insertion opening for a printed board, a plurality of spring contacts that project into this insertion opening from a pair of opposite walls surrounding the insertion opening and forming a contact point row along the lengthwise direction of the insertion opening, a pair of latch arms respectively extending and projecting from the housing at both end sides in the lengthwise direction of this insertion opening, elastically deformable towards the outside, and made integral with the housing, and a pair of engagement parts that are formed on these latch arms and engage the printed board on the latch arm by resisting the urging force of the spring contact when the printed board is inserted into the insertion opening and rotated until it is parallel with the latch arms, and wherein the latch arms are reinforced by a metallic reinforcement members that support the latch arms from the outside.

Here, it is preferable that the latch arm and the reinforcing member be integrally formed. In addition, one part of the reinforcing member is exposed where the latch arm contacts the printed board, and can function as a ground electrode for the printed board.

PREFERRED EMBODIMENT OF THE INVENTION

Figure 1:
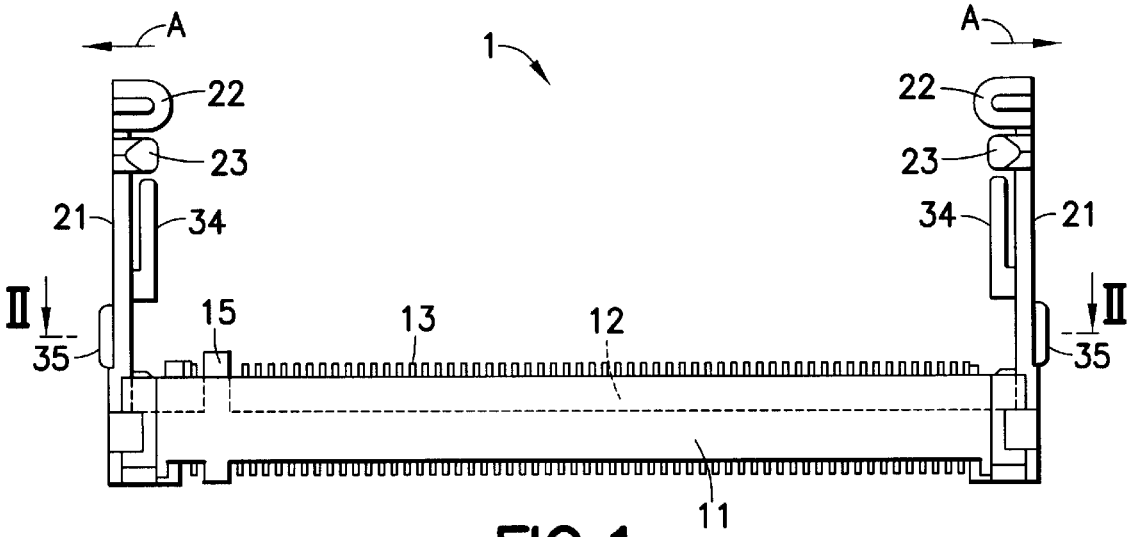
FIG. 1 is a frontal drawing along the direction of arrow I shown in FIG. 2, showing an example of a structure of the socket for a printed board according to the present invention.

Below, a preferred embodiment of the invention will be explained referring to the drawings.

Figure 2:
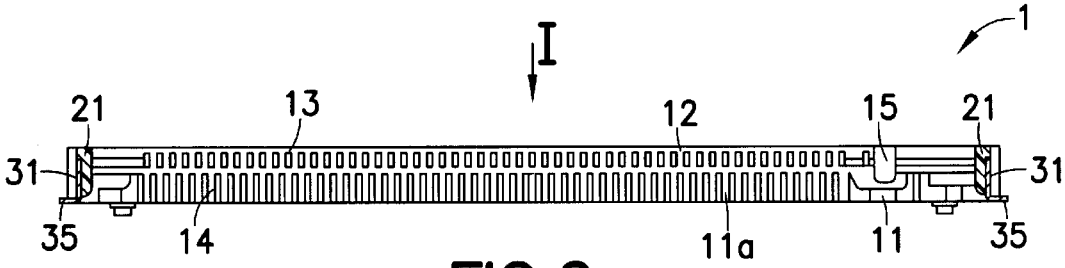
FIG. 2 is a cross-sectional drawing along the direction of arrow II—II shown in FIG. 1, showing an example of a structure of the socket for a printed board according to the present invention.

The total structure of the socket for a printed board (hereinafter, referred to as a "socket") according to the present invention is shown in FIG. 1 and FIG. 2. The socket generally comprises a housing 11 made of an insulating body (resin), a latch arm 21 similarly made of an insulating body, and a reinforcing member 31 made of a metal.

The housing 11 has a rectangular shape, and the inner side (the side showing by the reference numeral 11*a* in the figure) be installed on the mother board so as to face the surface of the mother board (not shown). In addition, at one end of the housing 11, a groove shaped opening 12 for the printed board opens along the lengthwise direction of the housing 11, and at the same time, one portion of a plurality of spring contacts arranged in the housing project from a pair of opposing walls that surround the insertion opening 12, forming contact point rows 13, 14 having a serrated form along the lengthwise direction of the insertion opening 12.

Here, in the contact point rows 13, 14, like the above-described conventional socket, the printed board inserted into the insertion opening 12 is disposed so as to be slanted towards the upper surface side of the housing 11. That is, the contact point row 13 positioned on the upper surface side of the housing 11 protrudes from the opposing wall towards the interior of the insertion opening 12, and the contact point row 14 positioned on the under surface 11*a* side of the housing projects from the opposite wall adjacent to the opened end of the insertion opening 12. In addition, on one end of the insertion opening 12, a polarizing pin 15 for preventing mistaken insertion when inserting the printed board into the insertion opening 12 is provided.

Figure 3:
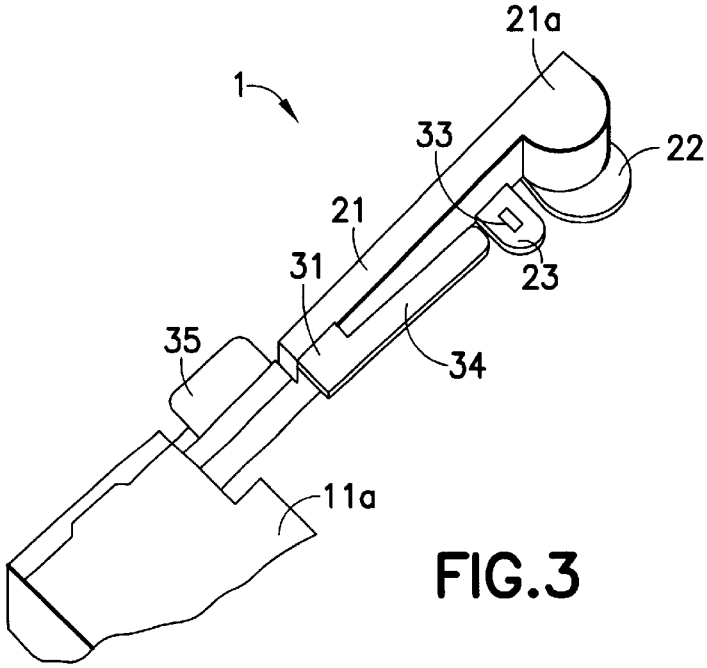
FIG. 3 is an enlarged diagram of the underside of the area of the latch arm, showing an example of a structure of the socket for a printed board according to the present invention.
Figure 4:
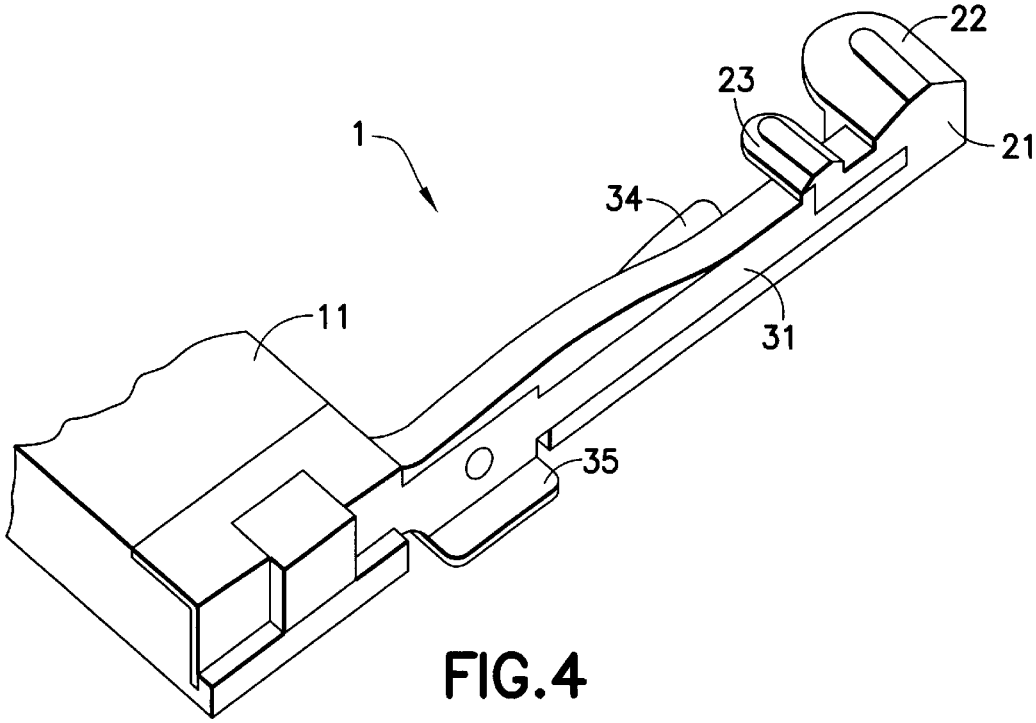
FIG. 4 is a perspective drawing from the top of the area of the latch arms, showing an example of a structure of the socket for a printed board according to the present invention.
Figure 5:
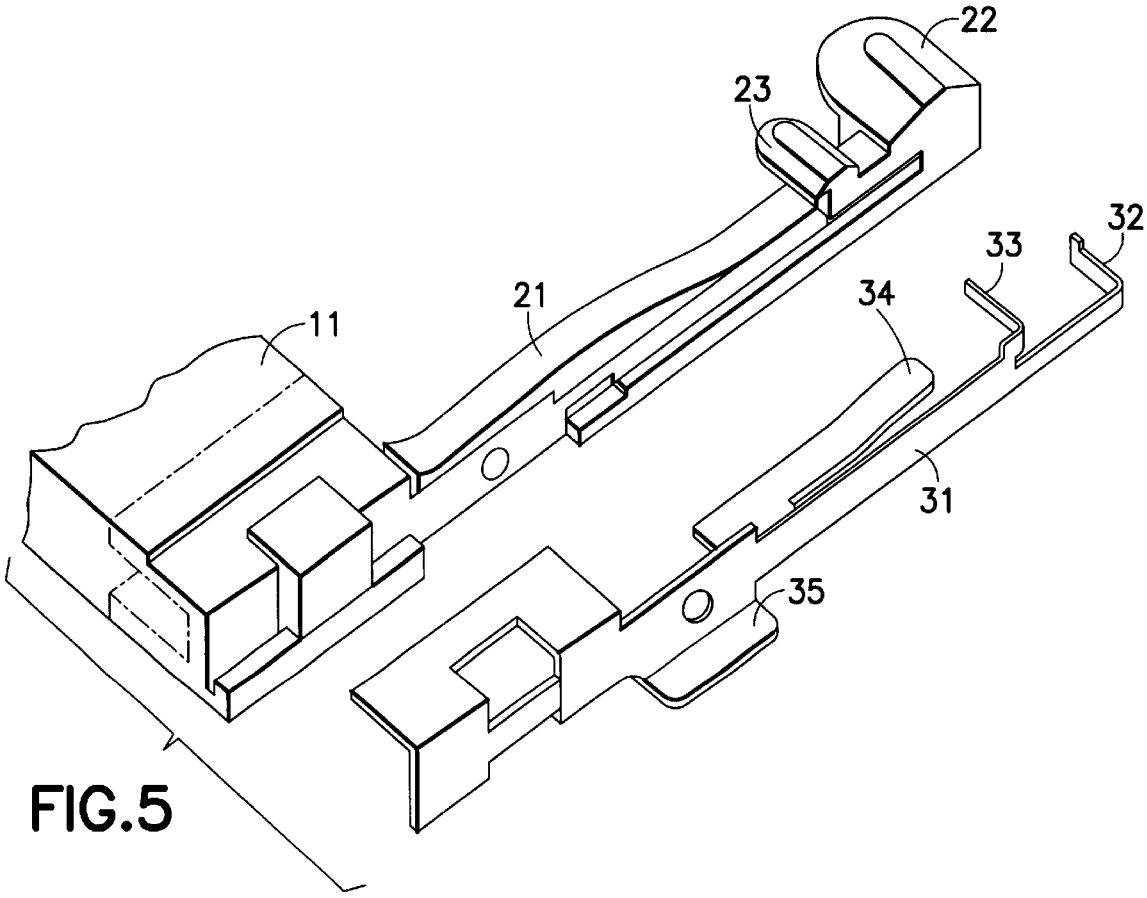
FIG. 5 is a perspective drawing from the top of the area of the latch arms in a state that the reinforcing member is removed from the latch arms shown in FIG. 4.

The details of the latch arms 21 and the reinforcing member 31 are shown in FIG. 3 through FIG. 5. The latch arms 21 are a pair of members that project along the direction of the opening of the insertion opening 12 from the housing 11, and as shown by the arrow S in FIG. 1, can elastically deform outwards (the side of mutual separation). In addition, the end of each latch arm 21, as shown in FIG. 3, forms a semi-circular part 21*a* projecting towards the inside, and on the semicircular part 21*a*, when installing the socket on the mother board, the semicircular ear part 22 projects towards the inside from the side surface positioned on the side separated from the mother board (that is, the frontal side of the socket).

On the proximal end side of the latch arms 21, from the ears 22, a semicircular engagement part 23 is formed projecting towards the inside from the side face positioned on the front side of the socket, like the ear 22. The entire length of the engagement part 23 is defined so that when a latch arm 21 is elastically deformed towards the outside, as shown by arrow A, due to operating the ear 22, the distal end of the engagement part 23 is positioned inside with respect to the side end face of the printed board mounted in the socket 1.

The reinforcing members 31 are for reinforcing the latch arms 21 by supporting the pair of latch arms 21 from the outside, and thus, as shown in FIG. 5, are made of a metallic plate having a total length roughly identical to the latch arms 21. On the reinforcing members 31, at the position corresponding to the ear 22 and the engagement part 23, projections 32, 33 respectively project facing the inside from the side surface positioned at the front side of the socket 1. As shown in FIG. 4, when the latch arms 21 are supported from the outside at the reinforcing members 31, these projections 32, 33 respectively become embedded within the ears 22 and the engagement parts 23, and the ear 22 and the engagement part 23 are reinforced. Furthermore, as shown in FIG. 3, the distal end of the projection embedded in the engagement part 23 protrudes at the underside of the engagement part 23. This exposed part contacts the upper surface of the printed board when mounted in the socket 1, and functions as a ground electrode.

The reference numeral 34 is an assist projection that bends one part of the reinforcing member towards the inside from the side end surface facing the under surface 11*a* of the socket at its center. The assist projection 34 gradually approaches the front side of the socket 1 while extending along the distal end side of the reinforcing member 31, and prevents excess rotation towards the under surface 11*a* side of the printed board by supporting the printed board while it is being mounted on the socket. At the same time, the assist projection 34 contacts the under surface of the printed board mounted on the socket 1, and also functions as a ground electrode. In addition, the reference numeral 35 is a fixed leg that bends the proximal end of the reinforcing member 31 towards the outside from the side end face towards the under surface 11*a* of the socket 1, and by fixing the fixed leg 35 on the mother board with a method such as soldering, the socket is installed on the motherboard, and the reinforcing member 31 is connected to the ground electrode of the mother board.

In the case of the present invention, the latch arms 21 and the reinforcing members 31 are integrally formed by a method such as insert formation, and the housing 11 and the combined latch arms 21/reinforcing members 31 are then made integral by a method such as insert molding. In an alternative embodiment, the housing 11 and the combined latch arms 21/reinforcing members 31 (as shown by the broken lines in FIG. 5) are molded separately, and furthermore, are made integral by a method such as an over mold, and are made into one member. Using either method results in the housing 11, latch arms 21 and reinforcing members 31 forming an integral product.

Figure 6:
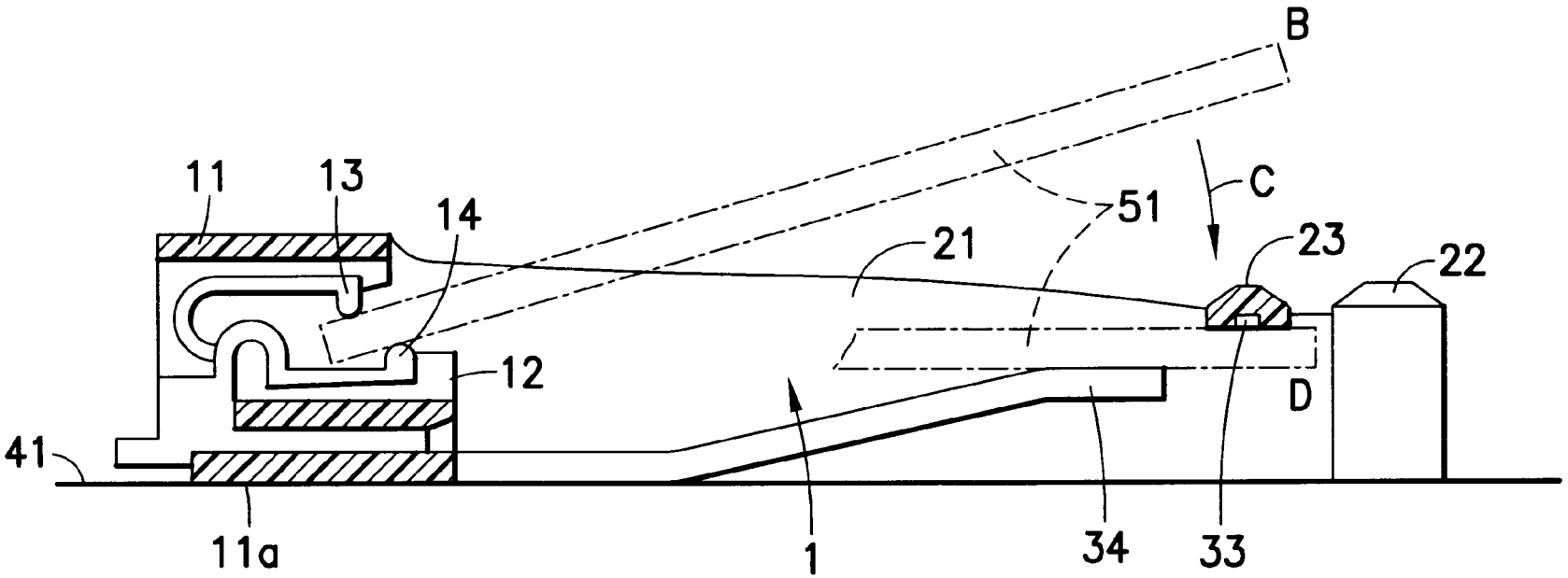
FIG. 6 is a cross-sectional drawing showing the general structure of the socket for the printed board installed on the mother board for explaining the operation of the socket for the printed board according to the present invention.

Next, the operation of the socket having the above-described structure is explained referring to FIG. 6. FIG. 6 is a cross-sectional drawing showing the general structure of the socket disposed on the mother board 41. When the distal end of the printed board 51 is inserted into the insertion opening 12, the printed board 51 is guided to the contact point rows 13, 14 disposed inside the insertion opening 12, and as shown by reference symbol B in the figure, is inclined towards the upper surface side of the housing 11 with its distal end serving as an axis. Next, as shown by arrow C in the figure, the printed board 51 is pressed down, and as shown by reference symbol D in the figure, the printed board 51 is rotated until it is parallel with the latch arm. Thereby, the distal end of the printed board 51 contacts the contact point rows 13, 14, and the printed board 51 is urged in the direction opposite to the direction of rotation, and at the same time, the contacts points formed at the distal end of the printed board 51 are securely connected with the connection point rows 13, 14.

In addition, accompanying the rotation of the printed board 51, the latch arms 21 are elastically deformed towards the outside as that the printed board passes over the engagement part 23. The latch arms 21 are restored to their original position when the printed board 51 has passed over the engagement part 23, and as a result, the movement of the printed board in the direction opposite to its direction of rotation is prevented by the engagement with the engagement part 23, and the printed board is supported parallel to the latch arms 21 by the resistance to the urging force of the spring contact formed on the contact point rows 13, 14. In this state, the printed board 51 is mounted on the socket 1. Furthermore, accompanying the mounting of the printed board 51 on the socket 1, the printed board is in contact with both the engagement part 23 and the assist projection 34, and connects to the ground electrode of the mother board 41 via the projection 33 exposed on the under side of the engagement part 23 and the assist projection.

When removing the printed board mounted on the socket 1, the engagement between the printed board 51 and the engagement part 23 is released when the latch arms 21 are elastically deformed towards the outside by operating the ear 22, and the printed board 51 is restored to the position shown by reference symbol B by the urging force of the spring contact.

In particular, in the case of the present invention, because the latch arms are made of resin, damage to the print board due to the contact between the printed board and the latch arms is prevented. In addition, because the latch arms 21 are supported by reinforcing members 31 made of metal that supports the latch arms 21 from the outside, even though the latch arms 21 are made of resin, they have superior durability. Because the latch arms 21 and the reinforcing members 31 are formed integrally, there is the effect that the labor and time necessary for fixing the reinforcing members 31 on the latch arms 21, and the time necessary for assembling a socket 1 are reduced.

Furthermore, accompanying the mounting of the printed board 51 on the socket 1, because the printed board 51 is connected to the ground electrode of the mother board 41 via the projection 33 and the assist projection 34, the printed board 51 can be easily and automatically connected by the mounting of the printed board 51 into the socket 1.

As explained above, according to the present invention, it is possible to provide a socket for a printed board having superior durability, doing no damage to the printed board due to contact therewith, and having a latch arm not requiring labor or time to assemble.

In addition, because one part of the reinforcing members reinforcing the latch arms function as ground electrodes for the printed board, accompanying the mounting of the printed board into the socket, the printed board can be easily and automatically connected.

What is claimed is:

1. A socket for a printed board comprising:

a housing having a groove shaped insertion opening for printed board insertion;

a plurality of spring connectors within said insertion opening that protrude from a pair of opposing walls that surround said insertion opening and form a line of contact points in the lengthwise direction of said insertion opening;

a pair of external deformable latch arms that respectively extend from said housing on both lengthwise ends of said insertion opening; and a pair of engaging parts that engage said printed board at said latch arms by resisting the urging force due to a spring contact; and wherein each said latch arms are reinforced by a metal reinforcing member that supports said latch arms from the outside, each of said latch arms and said reinforcing members being integrally formed into a combined latch arm and reinforcing member, and said housing comprising an overmolded housing member which is overmolded onto a portion of each of said combined latch arms and reinforcing members to form a stationary connection at said portion, and wherein said combined latch arms and reinforcing members are resiliently deflectable relative to said housing.

2. A socket for a printed board according to claim 1, characterized in one part of said reinforcing member being exposed at the point of contact with said printed board of said latch members, and acting as a ground electrode for said printed board.

3. An electrical connector housing, comprising:

a main body; and a latch arm assembly secured to said main body, said latch arm assembly including:

a resiliently flexible latch arm; and a metal reinforcement member embedded in said latch arm by overmolding, wherein said resiliently flexible latch arm comprises an overmolded member, wherein said latch arm assembly secures to said main body by overmolding at a stationary connection section, wherein said main body comprises an overmolded member.

4. The electrical connector housing as recited in claim 3, wherein said latch arm assembly and said main body are created simultaneously.

5. A method of making an electrical connector housing, comprising the steps of:

overmolding a latch arm onto an elastically deformable metal reinforcement member to form a resiliently flexible latch arm assembly; and overmolding a main body onto said latch arm or said latch arm assembly at a stationary connection point to form the connector housing with the latch arm being resiliently deflectable relative to the main body.

6. The method as recited in claim 5, wherein the overmolding steps occur simultaneously.

7. The socket for a printed board of claim 1, wherein the metal reinforcing member extends from the outside of the latch arm through the latch arm.

8. The socket for a printed board of claim 1 wherein the metal reinforcing member extends from the outside of the latch arm through the latch arm.

9. The socket for a printed board of claim 1 wherein the metal reinforcing member is secured to the outside of the latch arm by overmolding and wherein the metal reinforcing member is further secured to the housing by overmolding.

10. The socket for a printed board of claim 1 wherein both the metal reinforcing member and the latch arm are adapted to elastically deform together as a composite member when the printed board is inserted in the housing.

11. The socket for a printed board of claim 9 wherein both the metal reinforcing member and the latch arm are adapted to elastically deform together as a composite member when the printed board is inserted in the housing.

12. The electrical connector housing of claim 3 wherein the metal reinforcement member is further secured to said main body by overmolding.

13. The electrical connector housing of claim 3 wherein both the metal reinforcement member and the latch arm are adapted to elastically deform together as a composite member when a printed board is inserted in the main body.

14. The electrical connector housing of claim 3 wherein the metal reinforcement member extends from the outside of the latch arm through the latch arm.

15. The electrical connector housing of claim 13 wherein the metal reinforcement member extends from the outside of the latch arm through the latch arm.

16. The electrical connector housing of claim 3 wherein the metal reinforcement member supports the latch arm from the outside.

17. The electrical connector housing of claim 13 wherein the metal reinforcement member supports the latch arm from the outside.

18. The method of making an electrical connector housing of claim 5 wherein the step of overmolding a metal reinforcement member further comprises overmolding the metal reinforcement member into the latch arm wherein the metal reinforcement member supports the latch arm from the outside of the latch arm.

19. The method of making an electrical connector housing of claim 18 wherein the step of overmolding a metal reinforcement member further comprises overmolding the metal reinforcement member into the latch arm wherein the metal reinforcement member extends from the outside of the latch arm assembly through the latch arm.

* * * * *